United States Patent [19]

Wallace et al.

[11] 4,440,088

[45] Apr. 3, 1984

[54] FABRIC INSERTION SYSTEM

[75] Inventors: John A. Wallace, Everett; Bernard R. Bader, Bothell, both of Wash.

[73] Assignee: Black Clawson, Inc., Everett, Wash.

[21] Appl. No.: 83,891

[22] Filed: Oct. 11, 1979

[51] Int. Cl.[3] ..... E01B 1/00; E01B 37/00

[52] U.S. Cl. ..... 104/7 A; 37/105; 104/2; 238/2; 242/76; 242/86.52; 405/38; 405/258

[58] Field of Search ..... 104/1 R–7 R, 104/7 A, 7 B; 238/2; 37/104–107; 171/16; 242/76, 86.52; 405/36, 38, 45, 258, 270

[56] References Cited

U.S. PATENT DOCUMENTS

| | | | |
|---|---|---|---|
| 1,471,760 | 10/1923 | Ursino | 37/105 |
| 1,918,348 | 7/1933 | Neddermeyer | 104/2 |
| 2,420,833 | 5/1947 | Monroe | 238/2 |
| 2,575,390 | 11/1951 | McFadden | 104/2 |
| 2,769,172 | 10/1956 | Franco | 104/7 A |
| 2,921,390 | 1/1960 | Stein et al. | 37/104 |
| 2,921,537 | 1/1960 | Christoff | 104/7 A X |
| 2,921,538 | 1/1960 | Croonenberghs | 104/7 A X |
| 3,179,062 | 4/1965 | Christoff | 104/7 A |
| 3,368,729 | 2/1968 | Connelly et al. | 242/76 X |
| 3,621,785 | 11/1971 | Fearon et al. | 104/7 A X |
| 3,967,396 | 7/1976 | Maisonneuve et al. | 104/2 X |
| 4,064,807 | 12/1977 | Theurer | 104/7 A |
| 4,397,241 | 8/1983 | Newman | 104/2 |

FOREIGN PATENT DOCUMENTS

| | | | |
|---|---|---|---|
| 307476 | 5/1973 | Austria | 104/2 |
| 550745 | 9/1956 | Belgium | 242/86.52 |
| 2647159 | 4/1977 | Fed. Rep. of Germany | 405/38 |
| 59111 | 12/1967 | German Democratic Rep. | . |
| 550282 | 6/1974 | Switzerland | . |

*Primary Examiner*—Randolph Reese

*Attorney, Agent, or Firm*—Biebel, French & Nauman

[57] ABSTRACT

A fabric insertion system for placing fabric in the rock ballast roadbed of an existing railroad track at a predetermined depth beneath the ties of the track includes a car for supporting a roll of fabric which is to be inserted into the ballast. A fabric insertion sled is secured to the car in position beneath the car in the ballast at a predetermined depth beneath the ties. The sled receives fabric from the car and the fabric is diverted within the sled such that it emerges therefrom at the depth of the sled. Fabric is continuously inserted into the ballast as the car and sled are moved along the track.

11 Claims, 7 Drawing Figures

FABRIC INSERTION SYSTEM

BACKGROUND OF THE INVENTION

The present invention relates to railroad track construction and, more particularly, to a method and apparatus for inserting a fabric web into the rock ballast of a railroad track without disturbing substantially the ties, rails, or ballast of the track.

In conventional railroad track construction, railroad ties are placed in appropriate spaced relation on top of a subgrade. Rails are then spiked to the ties. Ballast material, consisting of crushed rock, is poured onto the ties and rails from a ballast car which moves along rails such that the ballast covers the rails and ties to the top of the rails. The rails and ties are then raised by a specially designed machine. The ballast is swept off the ties such that it fills the spaces between the ties. The ballast is worked in around the ties to provide a firm roadbed and the ballast on each side of the track is contoured.

Several problems have been encountered with railroad roadbeds of conventional construction. As trains pass over a track, the rails, ties, and ballast move up and down slightly, producing in the presence of moisture a pumping action which tends to draw sand and silt out of the substrate soil and up into the rock ballast. The contaminated ballast tends to hold water and, as a result, damage to the ballast from freeze/thaw cycles is increased. Additionally, the moisture retained in the contaminated ballast has an adverse effect upon the life of the wood railroad ties.

An additional problem occurs in regions in which the soil has a high silt content or in which the substrate soil is relatively soft. The pumping action resulting from the passage of trains over the track results in the gradual downward migration of the rock ballast into the substrate soil. As less and less ballast supports the ties, the stability of the roadbed is substantially reduced, thus reducing the speed at which trains may safely travel over the track.

Various approaches have been used to rehabilitate railroad tracks in which ballast has been lost or contaminated. U.S. Pat. No. 2,921,390, issued Jan. 19, 1960, to Stein et al, discloses a ballast plow which is inserted between the roadbed and the ties. The plow is towed along the track in this position by a locomotive and, as it progresses, it raises the ties from the roadbed, supports the ties and the track as it passes underneath and, finally, allows the ties and tracks to resettle onto the roadbed behind the plow. By providing the plow with a scraper blade, it is possible to separate an upper layer of fouled ballast and replace it with fresh ballast before the ties are finally relaid.

U.S. Pat. No. 2,769,172, issued Oct. 30, 1956, to Franco, discloses a sled which is towed beneath the ties and which raises the ties up to their desired level and evenly distributes clean ballast which was previously poured on top of the ties and rails. Additional ballast must thereafter be inserted between adjacent ties. The sled shown in the Franco patent spreads and levels the ballast before permitting the ties to settle onto the ballast behind the sled.

U.S. Pat. No. 2,921,538, and U.S. Pat. No. 2,921,537 to Croonenberghs and Christoff, respectively, both issued Jan. 19, 1960, disclose a plow which is pulled beneath the ties of a railroad track to "skeletonize" the track, that is, to remove the fouled ballast from beneath the track, as the first step in the rehabilitating a section of track. Finally, U.S. Pat. No. 2,575,390, issued Nov. 20, 1951, to McFadden, discloses a ballast working grid which is pulled through the ballast beneath the ties of a railroad track to distribute evenly newly applied ballast.

While such prior art devices may be utilized to reballast a pre-existing railroad track which has lost a portion of its ballast through downward migration of the rock ballast into the soil or in which the ballast has become contaminated through upward movement of silt and sand into the gravel, such rehabilitation techniques are expensive and, additionally, may render sections of the track unusable for extended periods during the rehabilitation and repair process.

In order to reduce the amount of maintenance work required for railroad tracks, a yielding foundation for the ballast has been suggested, as illustrated in U.S. Pat. No. 2,420,333, issued May 20, 1947,to Monroe. In the Monroe foundation, a rubber composition apron is positioned beneath the ballast, with the apron overlying a layer of bituminous cement. The cement, in turn, rests upon a mastic cushion, such as a layer of sand or gravel which is mixed with bitumen. This inhibits the upward migration of water, which would otherwise carry silt into the ballast beneath the railroad ties. The Monroe foundation is practical only for new track construction, since it cannot be added to existing tracks without removing the ties and rails and rebuilding the roadbed.

A more recently developed approach to reducing the problems associated with contamination of rock ballast is to place a sheet of fabric in or beneath the layer of ballast in the railroad roadbed. Typically, a spun polypropylene fabric is utilized, such as any of the following: SUPAC fabric by Philips Perroleum; TYPAR fabric by DuPont; BIDIM fabric by Montsano; and True Tex VT-5000 fabric by True Temper. Such fabrics permit moisture to drain from the ballast, while at the same time preventing upward migration of contaminants.

The use of such fabrics has been relatively limited, however, due to the difficulty of placing the fabric in the ballast of the roadbed of a pre-existing railroad track. In one prior art fabric insertion technique, the rails, ties, and ballast were removed prior to laying down a web of the fabric on the roadbed. Alternatively, a ballast plow has been used for removing ballast from a section of the track and a small roll of the fabric was placed beneath the ties and unrolled, prior to reballasting the track section. Such known techniques for inserting the fabric into the roadbed of a pre-existing track are relatively expensive and time consuming and, as a consequence, have not been widely accepted.

Accordingly, there is a need for a method and apparatus capable of inserting a web of fabric into the ballast of a railroad roadbed without substantially distrubing the tracks, ties, or ballast.

SUMMARY OF THE INVENTION

A fabric insertion system for placing fabric in the rock ballast roadbed of a railroad track at a predetermined depth beneath the ties of the track, includes a car for supporting a roll of fabric to be inserted into the roadbed. A fabric insertion sled is secured to the car and is positioned beneath the car in the ballast at the predetermined depth. The sled has a fabric inlet opening to one side thereof and a fabric outlet opening. The sled receives the fabric through the inlet opening. The sled further includes means for diverting the fabric within the sled such that it emerges from the sled at the predetermined depth. A means is provided for moving the car and the sled along the track as the fabric from the roll is fed into the inlet opening, whereby the fabric emerges from the fabric outlet opening and is inserted into the ballast at the predetermined depth beneath the ties.

The fabric outlet opening may extend across the top of the sled at an angle of approximately 45° with respect to the direction of movement of the sled through the ballast. The sled may further include a cover, extending across the sled above the fabric outlet opening, for preventing ballast from entering the fabric outlet opening. The sled may also comprise an upwardly extending chute defining the fabric inlet opening, with the chute extending along one side of the sled. The forward edge of the sled may be serrated to facilitate movement of the sled through the ballast.

The system may further comprise a plurality of hydraulic mounting means which extend between the sled and the car and secure the sled to the car. The lengths of the mounting means are hydraulically controllable, whereby the depth of the sled beneath the ties may be controlled and the depth at which the fabric is inserted into the ballast determined.

The fabric insertion system may also include means on the car for contouring the soil adjacent the roadbed to permit the fabric insertion sled to be inserted laterally into the ballast at the desired depth. Additionally, the fabric insertion system may include extensible support means on the car for engaging the soil adjacent the roadbed during insertion of the sled into the ballast, whereby the car is stabilized. The fabric insertion system may have means for engaging the ties and rails during insertion of the sled into the ballast and for raising the ties and rails, thereby facilitating insertion of the sled into the ballast. Ballast contouring means may be mounted on the car rearward of the sled for contouring the ballast edges after the fabric is inserted into the ballast through the sled.

The fabric web is inserted into the ballast of an existing railroad track without removing the rails or the ties resting in and supported by the ballast, according to the following steps:

(a) positioning a fabric insertion sled in the ballast beneath the ties;

(b) moving the sled through the ballast while maintaining the sled at a predetermined depth in the ballast;

(c) unreeling a fabric web roll and feeding the web into the sled, while moving the roll along the track; and (d) directing the web rearwardly from the sled, whereby the web is inserted into the ballast at the predetermined depth of the sled in the ballast.

The step of positioning the fabric insertion sled in the ballast included the steps of: placing the sled to the side of the track; lifting the rails and ties adjacent the sled; moving the sled into the ballast at the predetermined depth beneath the ties; and, lowering the rails and ties.

Accordingly, it is an object of the present invention to provide an apparatus and method for inserting a fabric web into the ballast of a railroad track without disturbing substantially the rails or ties thereof; to provide such an apparatus and method in which the fabric web is supplied to a sled which is pulled through the ballast and from which the web emerges at a predetermined depth; and to provide such apparatus and method in which the sled is constructed to permit a train to pass over the sled on the tracks without removing the sled from the ballast.

Other objects and advantages of the invention will be apparent from the following description, the accompanying drawings and the appended claims.

DETAILED DESCRIPTION OF THE PREFERRED EMBODIMENTS

Figure 1:
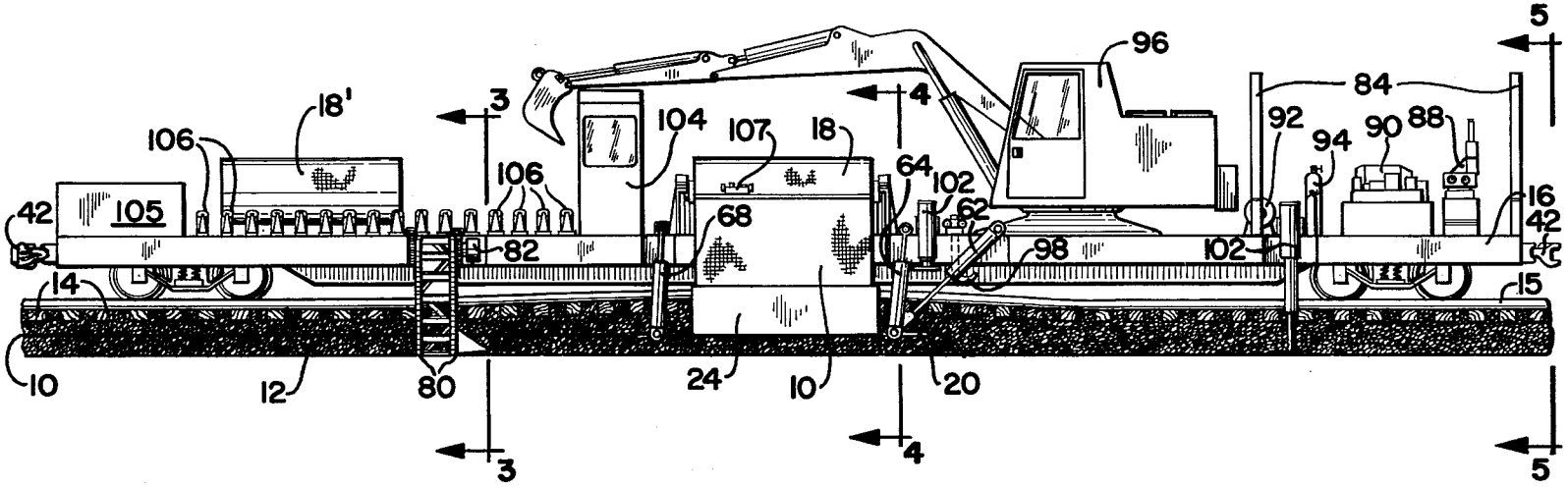
FIG. 1 is a front view of a fabric insertion system according to the present invention.
Figure 2:
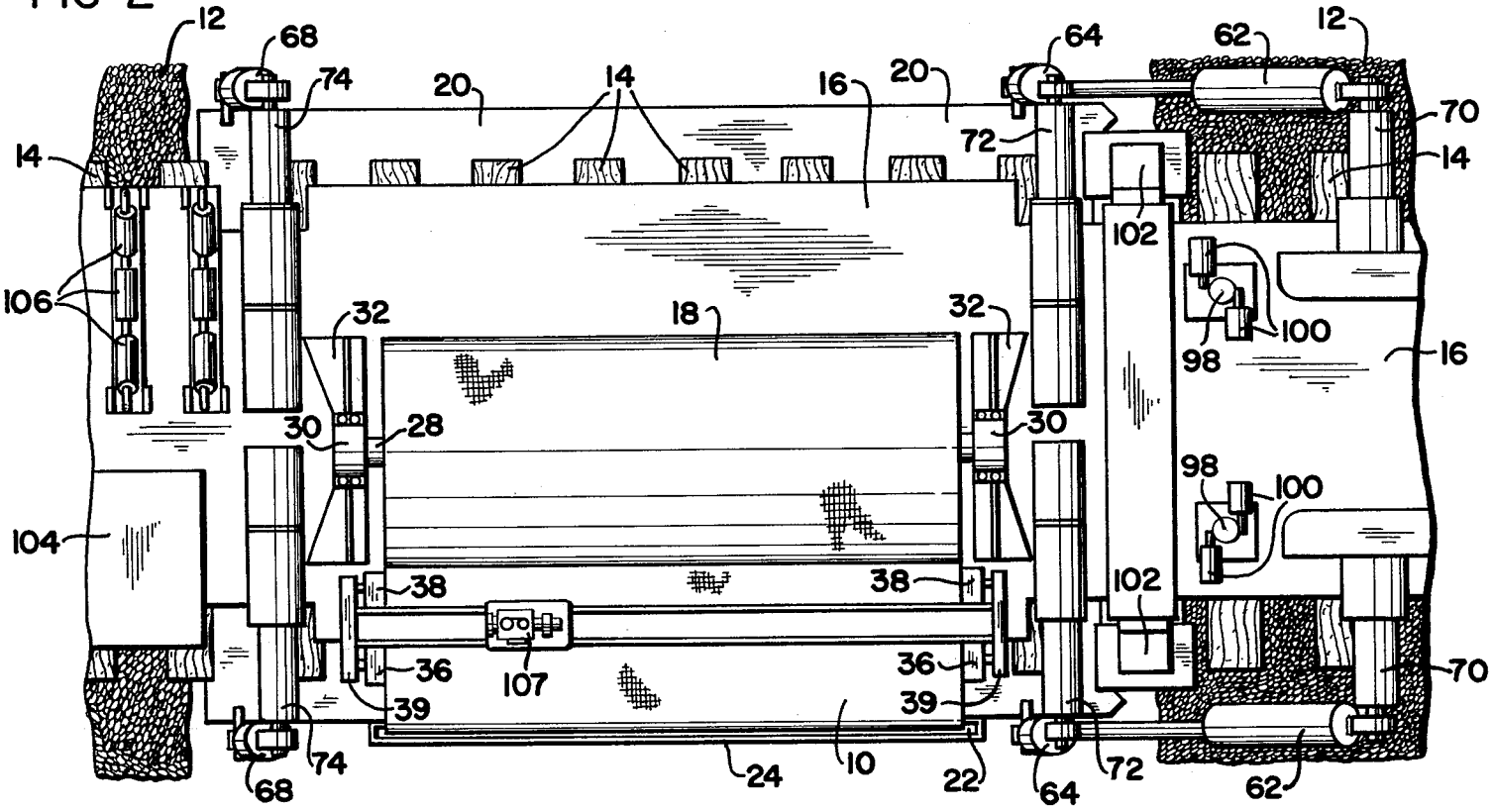
FIG. 2 is an enlarged partial plan view of the fabric insertion system of FIG. 1 with the roadbed ballast removed to reveal the fabric insertion sled.

FIGS. 1 and 2 illustrate the fabric insertion system of the present invention by which fabric 10 is placed in the rock ballast roadbed 12 of an existing railroad track at a predetermined depth beneath the ties 14 and rails 15. The system includes a car 16 for supporting a roll 18 of fabric which is to be inserted into the ballast 12.

Figure 6:
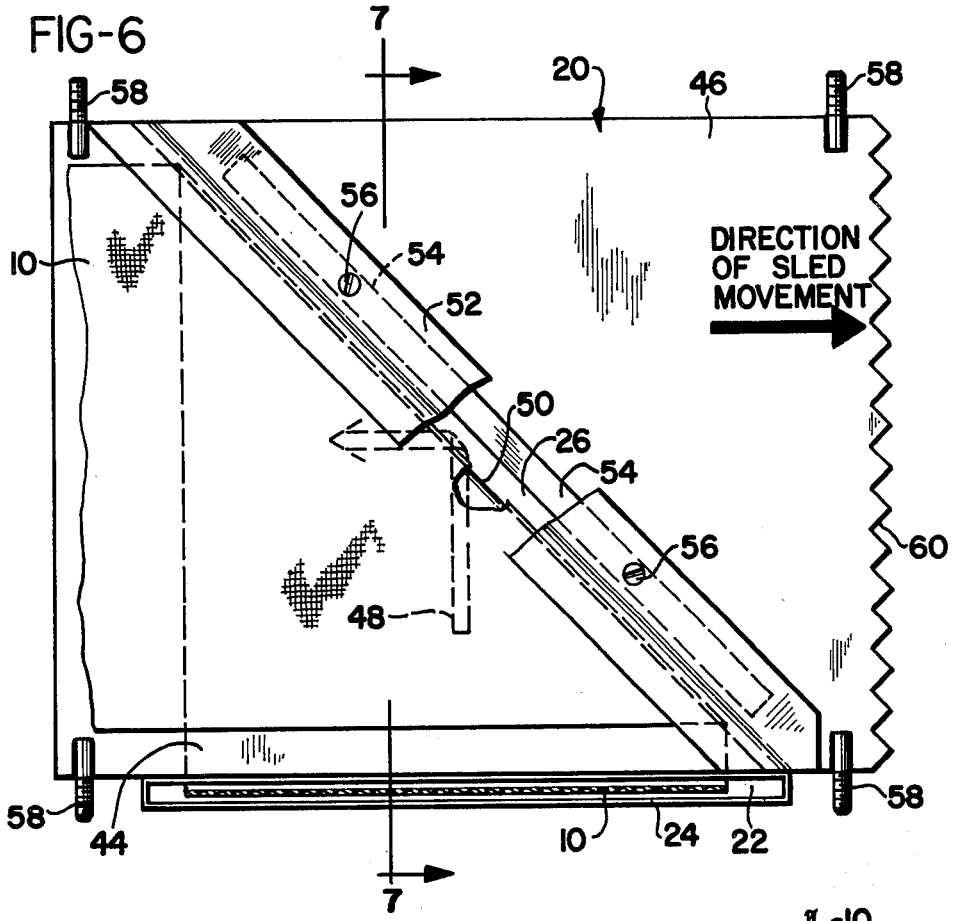
FIG. 6 is a plan view of the fabric insertion sled of the present invention with portions broken away to reveal interior structure.
Figure 7:
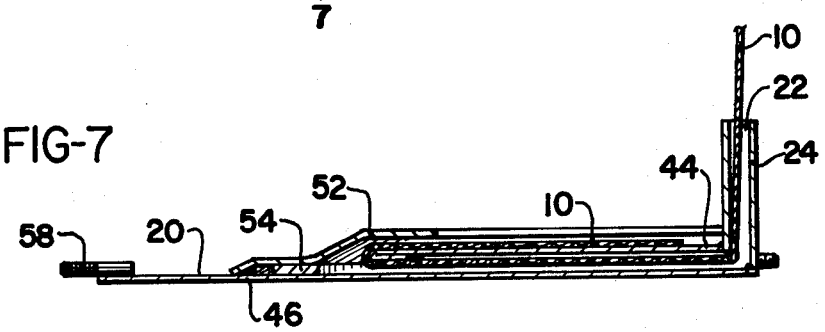
FIG. 7 is a sectional view taken generally along line 7—7 in FIG. 6.

A fabric insertion sled 20, shown more completely in FIGS. 6 and 7, is secured to car 16 and positioned beneath the car in the ballast 12 at a predetermined depth beneath the ties 14. Sled 20 has a fabric inlet opening 22, defined by chute 24 to one side of the sled 20 and a fabric outlet opening 26 across the upper surface of the sled 20. The sled 20 may be made of hardened steel or other metal alloy materials.

Figure 4:
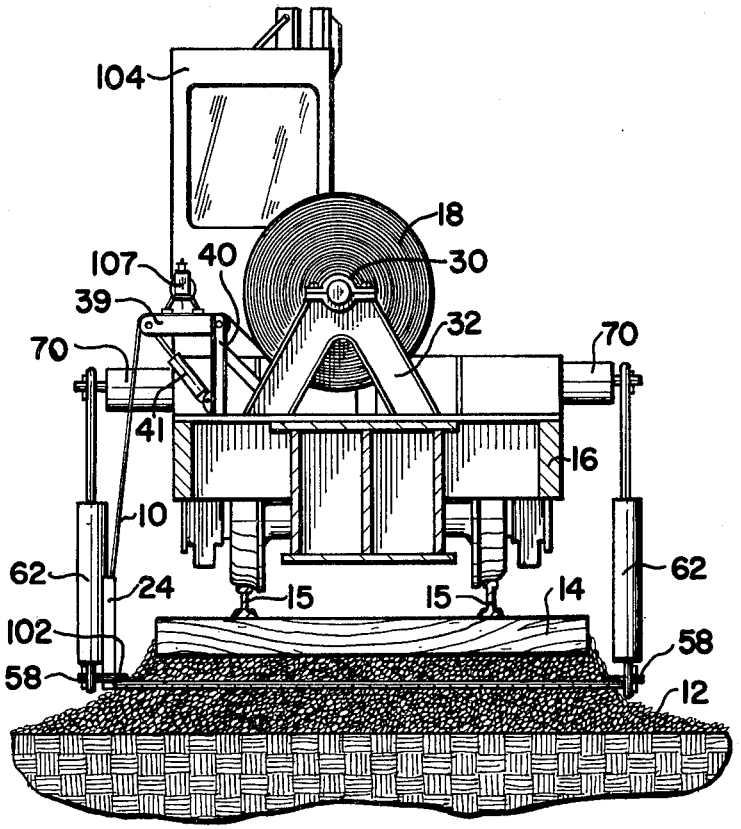
FIG. 4 is a sectional view taken generally along line 4—4 in FIG. 1.

Fabric roll 18 is supported on a roll spindle 28 held by bearings 30 in supports 32. Fabric 10 from roll 18 passes over guide rollers 36 and 38, which rollers are journaled in arms 39 pivotally mounted on supports 40 (FIG. 4). Orientation of the rollers 36 and 38 and the tension of the fabric 10 are controlled by hydraulic cylinder 41. The fabric 34 then passes downward into chute 24. Couplings 42 at each end of the car 16 provide a means for connecting the car to a locomotive and moving the car and the sled along the track. As the sled is moved through the ballast, fabric from the roll 18 is fed into the inlet opening 22 of the sled and emerges from the sled through the fabric outlet opening 26 such that the fabric is inserted into the ballast 12 at the predetermined depth beneath the ties 14. The car 16 and sled 20 can be pushed or pulled by the locomotive along the track.

As seen in FIGS. 6 and 7, the fabric outlet opening 26 extends across the upper surface of the sled 20 at an angle of approximately 45° with respect to the direction of sled movement through the ballast 12. The fabric 10 passes downwardly through opening 22 in chute 24 into the interior of the sled 20, defined by plates 44 and 46. As diagrammatically illustrated by phantom arrow 48, the fabric travels laterally within the sled 20 and, thereafter, passes upward through opening 26 and around edge 50 defined by plate 44. Since edge 50 is inclined 45° with respect to the direction of travel of the sled 20, the fabric 34 is diverted as it passes around edge 50 by approximately 90° with respect to its direction of movement through the sled. It will be understood, of course, that the movement of the fabric 34 discussed above is movement with respect to the sled, and that as the fabric 34 emerges from opening 26, and travels along the upper surface of the sled, there is no relative movement between the fabric 10 and the ballast 12 through which the sled moves.

A cover 52, secured to cover support 54 by means of fasteners 56, extends across the top of the sled 20, above the fabric outlet opening 26, for preventing ballast from entering the opening 26. Shafts 58, secured to the sled 20, provide a means for attaching the sled to the car 16, as described more fully below. The forward edge 60 of the sled 20 is serrated or toothed, whereby movement of the sled through the ballast is facilitated.

A plurality of hydraulic mounting means, including hydraulic cylinders 62, 64, and 68 extend between the sled 20 and the car 16 and secure the sled to the car. The bottom portions of cylinders 62, 64, and 68 are secured to shafts 58. The upper ends of cylinders 62 are pivotally attached to support 70; the upper ends of cylinders 64 are pivotally attached to supports 72; and the upper ends of cylinders 68 are pivotally secured to supports 74. The lengths of hydraulic cylinders 62–68 are controllable hydraulically such that the depth of the sled 20 beneath the ties 14 may be adjusted to control the depth at which the fabric 10 is inserted into the ballast.

Figure 3:
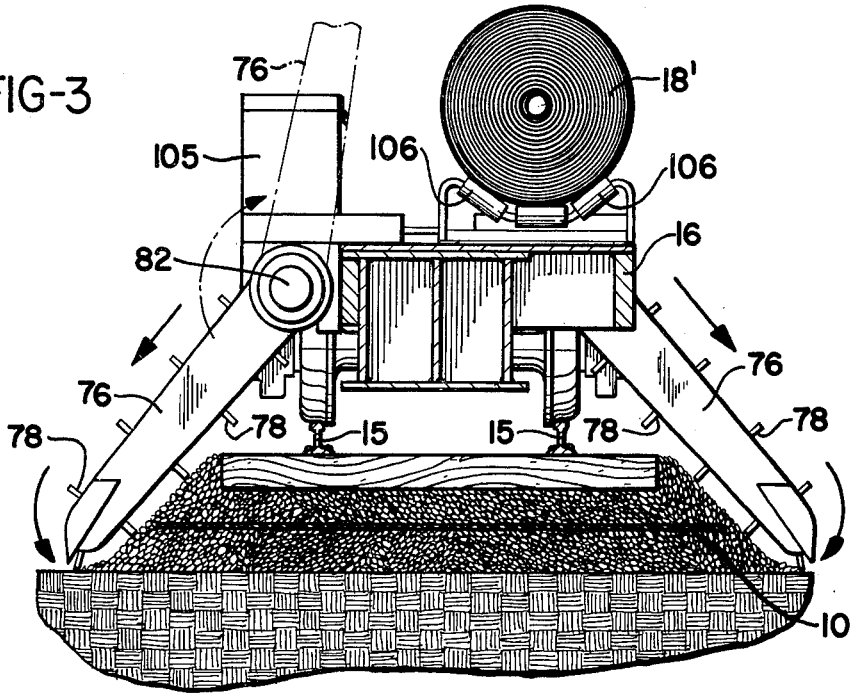
FIG. 3 is a sectional view taken generally along line 3—in FIG. 1.

As the car 16 is moved along the track and fabric from the roll 18 inserted into the ballast 12 through the sled 20, the ballast 12 tends to be spread outwardly from the roadbed onto the ground to either side of the track. In order to move the ballast 12 back into position adjacent the track, a pair of ballast contouring assemblies 76 are mounted on the car 16, as shown in FIG. 3. Each of the assemblies 76 is pivotable, as illustrated, into a working position in which a plurality of blades 78, attached to chains 80, are driven by hydraulic motors 82 to recontour the ballast on both sides of the track. Other types of ballast contouring devices may also be used.

Figure 5:
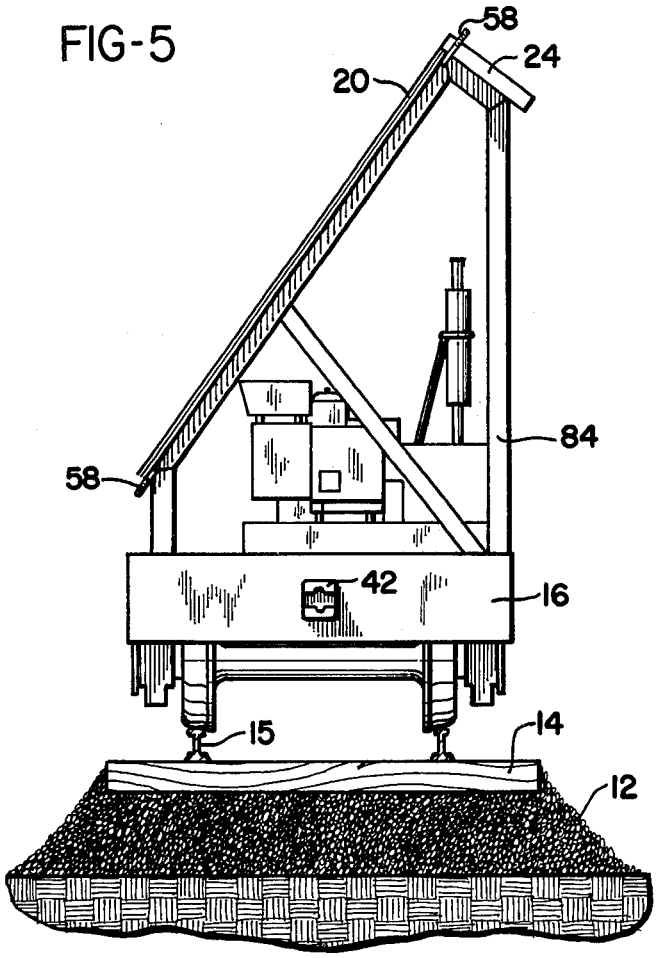
FIG. 5 is an end view of the fabric insertion system taken generally along line 5—5 in FIG. 1.

Also mounted on car 16 is a sled support rack 84. As shown in FIG. 5, rack 84 is used to support sled 20 when the car 16 is being transported to a location where the fabric insertion process is to be initiated.

The car 16 includes a number of devices which help make it self-contained. A diesel powered generator 88 provides electrical power for the car. A hydraulic power unit and reservoir 90, driven by an electric motor, provides hydraulic power for operating a number of hydraulic devices on the car, including cylinders 62, 64, and 68. An arc welding machine 92 and a gas torch set 94 are provided for welding and cutting as required for maintenance and repairs.

An excavator 96, mounted on top of the car 16, has a number of uses, including excavating the ground adjacent the roadbed prior to insertion of the sled 20 into the ballast, as more completely described below. The excavator 96 is also used as a crane for loading of a roll of fabric 18 onto the fabric supporting spindle 28. Hooks 98, powered by motors 100, may be lowered to engage the rails 15 and raise the ties and rails at the time of insertion of the sled 20 into the ballast 12.

Extensible support means include support arms 102, which are extended hydraulically to engage the ground adjacent the roadbed during insertion of the sled 20 into the ballast 12, thus stabilizing the car 16. Although one of the support arms 102 is shown in its extended position in FIG. 1, it will be understood that the arms are extended only at the time of insertion of the sled into the ballast 12, and that the arms are thereafter retracted and remain retracted during the fabric insertion process. The extensible support arms 102 may also be used during removal of the sled 20.

An operator control cab 104 is provided from which control of the fabric insertion system may be accomplished. Also mounted on the car 16 is a storage cabinet 105 for storing tools and spare parts.

Additional rolls of fabric are transported on a fabric roll storage railroad car which is coupled to car 16. A plurality of groups of rollers 106, each roller group consisting of three rollers arranged generally in a U-shape configuration, extend along the top of the car. As seen in FIG. 1, a roll 18' of fabric, which has been transferrred from the accompanying fabric roll storage car onto the rollers 106, is moved along the rollers 106 to a point adjacent the support spindle 28. By using the excavator 96 as a crane, the roll 18' may be placed in position on the spindle 28 when the previously inserted roll 18 is depleted. The end of the roll 18' is then sewed or otherwise joined to the end of the previously inserted fabric roll by seaming device 107.

It will be appreciated that other means may be provided for transferring a roll of fabric 18' from the accompanying fabric roll storage car to the spindle 28. An overhead crane device, for instance, may be mounted on the car 16 in place of the rollers 106 and utilized for this transfer.

When a fabric web is to be inserted into the ballast of a section of track, the car 16 is moved to the starting point for the insertion operation. Arms 102 are thereafter extended into contact with the ground adjacent the track to stabilize the car 16. The sled 20 is then removed from the rack 84, using the excavator 96 as a crane, and placed on the ground to the side of the track, next to the excavator 96. Hooks 98 engage and raise rails 15, thus pulling the rails 15 and ties 14 upward in the area beneath the excavator 96. The excavator 96 is used to push the sled 20 laterally into the ballast 12 at the desired level. Thereafter, the rails 15 and ties 14 are lowered, and the hooks 98 disengage from the rails. The arms 102 are retracted and the car 16 is rolled forward until the sled 20 is directly beneath the roll 18, in the position illustrated in FIG. 1. Cylinders 62, 64, and 68 are attached to the sled 20 and the fabric insertion operation may be initiated. It will be understood that the end of the roll 18 of fabric is inserted into the sled 20 prior to shifting the sled 20 into the ballast 12 such that it emerges from the opening 26.

When the sled 20 is initially inserted into the ballast 12, the sled may not be at precisely the desired depth. Correction of the depth of the sled in the ballast is accomplished as the car 16 is moved along the track by gradual extension or retraction of the cylinders 62, 64, and 68.

Occasionally, it may be desired to insert the sled 20 into the ballast at a point along the track in which the adjacent terrain prevents positioning the sled next to the roadbed at the required level. Such may be the case, for example, where the ground adjacent the roadbed slopes sharply upward. In such an instance, the excavator 96 is used to excavate the earth adjacent the roadbed and prepare a level area upon which the sled 20 is placed prior to its insertion into the roadbed.

It should be noted that the fabric insertion system of the present invention provides several additional advantages. The slight upward deflection of the track caused by the passage of the sled through the ballast occurs only between the wheels of the car 16. Since the ballast 12, ties and rails are front and rear lifted upward by the sled 20 at the same time that the fabric web is being inserted, skeletonizing of the track is prevented. Also, since the track is not skeletonized during insertion of the fabric and since the sled is very thin, it is possible to disconnect the sled 20 from the car 16 and move the car onto a siding to permit a train to pass over a section of track, while leaving the sled in place within the ballast.

It will be appreciated that it may be desirable to insert the sled 20 into the ballast from either side of the track. For this purpose, a pair of sleds 20 may be provided, with one of the pair having its chute on the right hand side of the sled and the other of the pair having its chute on the left hand side of the sled, as seen looking from the front of the sled. It will be appreciated, however, that such a system requires a fabric roll support arrangement capable of unreeling a roll of fabric over either side of the car, in dependence upon the sled in use.

While the method and form of apparatus herein described constitute preferred embodiments of the invention, it is to be understood that the invention is not limited to. this precise method and apparatus, and that changes may be made therein without departing from the scope of the invention.

What is claimed is:

1. A fabric insertion system for placing fabric in the rock ballast road bed of a railroad track at a predetermined depth in said ballast, comprising:

a car for supporting fabric to be inserted into the ballast, and a fabric insertion sled secured to said car and positionable beneath said car in said ballast at said predetermined depth, said sled having a fabric inlet opening to one side thereof and a fabric outlet opening which extends across the upper surface of said sled at an angle of approximately 45° with respect to the direction of movement of said sled through said ballast, said sled receiving the fabric through said inlet opening such that said fabric emerges from said sled through said outlet opening and slides across said upper surface of said sled passing rearwardly from said outlet opening, and is positioned at said predetermined depth.

2. The fabric insertion system of claim 1, further comprising means for moving said car and said sled aLong said track as said fabric is fed into said inlet opening, whereby said fabric emerges from said fabric outlet opening and is inserted into said ballast at said predetermined depth.

3. The fabric insertion system of claim 1 in which said sled further comprises means for diverting the fabric within said sled.

4. Ihe fabric insertion system of claim 1 in which said sled further comprises a cover extending across said sled above said fabric outlet opening for preventing ballast from entering said fabric outlet opening.

5. The fabric insertion system of claim 1 in which said sled further comprises an upwardly extending chute defining said fabric inlet opening, said chute extending along one side of said sled.

6. A fabric insertion system of claim 1 in which the forward edge of said sled is serrated, whereby movement of the sled through the ballast is facilitated.

7. A fabric insertion system of claim 1 further comprising hydraulic mounting means, extending between said sled and said car, for securing said sled to said car, said mounting means being hydraulically controllable, whereby the depth of said sled in said ballast may be controlled and the depth at which said fabric is inserted into said ballast determined.

8. The fabric insertion system of claim 1 further comprising means on said car for contouring soil adjacent said roadbed to permit said fabric insertion sled to be inserted laterally into said ballast at the desired depth.

9. The fabric insertion system of claim 8 further comprising extensible support means on said car for engaging the soil adjacent said roadbed during insertion of said sled into said ballast, whereby said car is stabilized.

10. The fabric insertion system of claim 9 further comprising means for engaging and raising said track during insertion of said sled into said ballast, whereby insertion of said sled into said ballast is facilitated.

11. The fabric insertion system of claim 1 further comprising ballast contouring means on said car rearward of said sled for contouring said ballast after said fabric is inserted into said ballast through said sled.

* * * * *

UNITED STATES PATENT AND TRADEMARK OFFICE

CERTIFICATE OF CORRECTION

PATENT NO. : 4,440,088

DATED : April 3, 1984

INVENTOR(S) : Bernard R. Bader, John A. Wallace

It is certified that error appears in the above-identified patent and that said Letters Patent is hereby corrected as shown below:

Column 2, line 55, "distrubing" should be --disturbing--.

Column 4, line 12, "line 3- in" should be --line 3-3 in--.

Column 7, line 23, "limited to." should be --limited to--.

Claim 2, column 8, line 3, "aLong" should be --along--.

Claim 4, column 8, line 11, "Ihe" should be --The--.

Signed and Sealed this

*Third* Day of *July 1984*

[SEAL]

*Attest:*

GERALD J. MOSSINGHOFF

*Attesting Officer*

*Commissioner of Patents and Trademarks*